US005996151A

United States Patent [19]

Bartow et al.

[11] Patent Number: 5,996,151

[45] Date of Patent: Dec. 7, 1999

[54] BALANCED FOWLER DESIGN

[75] Inventors: Richard J. Bartow, Battle Creek; Martin W. Stryker; Geary A. North, both of Kalamazoo; Richard L. McDaniel, Constantine, all of Mich.

[73] Assignee: Stryker Corporation, Kalamazoo, Mich.

[21] Appl. No.: 09/004,753

[22] Filed: Jan. 8, 1998

Related U.S. Application Data

[60] Provisional application No. 60/035,364, Jan. 10, 1997.

[51] Int. Cl.[6] ..... A61G 7/015

[52] U.S. Cl. ..... 5/613; 5/611; 5/617

[58] Field of Search ..... 5/611, 613, 617; 297/344.15, 354.13

[56] References Cited

U.S. PATENT DOCUMENTS

| | | | |
|---|---|---|---|
| 979,461 | 12/1910 | Gale . | |
| 2,747,919 | 5/1956 | Ferneau et al. | 296/20 |
| 2,837,751 | 6/1958 | McCall | 5/80 |
| 2,956,289 | 10/1960 | Sullivan | 5/67 |
| 3,036,314 | 5/1962 | Wetzler | 5/63 |
| 3,039,119 | 6/1962 | Bourgraf et al. | 5/32 |
| 3,053,568 | 9/1962 | Miller | 297/78 |
| 3,319,270 | 5/1967 | Greiner | 5/66 |
| 3,353,193 | 11/1967 | Greiner | 5/66 |
| 4,222,131 | 9/1980 | Holdt et al. | 5/617 |
| 4,380,838 | 4/1983 | Lutchansky | 5/615 |
| 4,604,022 | 8/1986 | Bourgraf | 414/340 |
| 5,402,544 | 4/1995 | Crawford et al. | 297/354.13 X |
| 5,678,264 | 10/1997 | Walker | 5/617 X |

FOREIGN PATENT DOCUMENTS

| | | | |
|---|---|---|---|
| 74802 | 5/1954 | Netherlands | 5/617 |

*Primary Examiner*—Michael F. Trettel

*Attorney, Agent, or Firm*—Flynn, Thiel, Boutell & Tanis, P.C.

[57] ABSTRACT

A patient support stretcher which includes a base and a main frame portion coupled to the base through at least one pair of crossbars forming an X-shaped configuration. The crossbars are pivotally connected to one another and are pivotally connected to the base and the main frame portion. A back support or a fowler section is hinged to the main frame portion and a strut interconnects the back support to the main frame to provide the requisite balanced leverage for effecting the simultaneous lift of the main frame and the fowler section.

16 Claims, 3 Drawing Sheets

BALANCED FOWLER DESIGN

This application is a cip of U.S. Provisional Ser. No. 60/035,364 filed Jan. 10, 1997.

FIELD OF THE INVENTION

The present invention relates to an improved stretcher and in particular, to a patient support stretcher having a balanced fowler design, namely, a design that will allow low effort positioning of a patient support surface vary from a seated position to a reclining position or any position in between and without the need for hydraulic or spring assist.

BACKGROUND OF THE INVENTION

With patient support stretchers, it is desirable to have the patient at a height which is easily accessible by medical personnel standing by the stretcher. Additionally, it is desirable to have a stretcher which is low so that the patient can easily be placed on the stretcher. Typically, stretchers will employ hydraulic cylinders having very long rods to accomplish both of these desired results. By lowering the hydraulic cylinders, the patient can be positioned onto the stretcher and then by pumping the hydraulic cylinder, the patient can be raised to the desired height. However, the hydraulic cylinders that are employed are expensive and there is a rather long period of time required to pump the cylinder to raise the patient from the lower position to the desired higher position.

It is an object of the present invention, to make it possible for the medical personnel to merely pull the fowler portion back which raises the patient a portion of the required height. The remaining height can then be obtained by use of a smaller hydraulic cylinder which takes less time to raise the patient support to the desired height.

SUMMARY OF THE INVENTION

The objects and purposes of the invention are met by providing a patient support stretcher which includes a base and a main frame portion coupled to the base through at least one pair of crossbars forming an X-shaped configuration. The crossbars are pivotally connected to one another and are pivotally connected to the base and the main frame portion. A back support or fowler section is hinged to the main frame portion and a strut interconnects the back support to the main frame to provide the requisite balanced leverage for effecting the lift of the main frame and fowler section.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DISCUSSION

Figure 1:
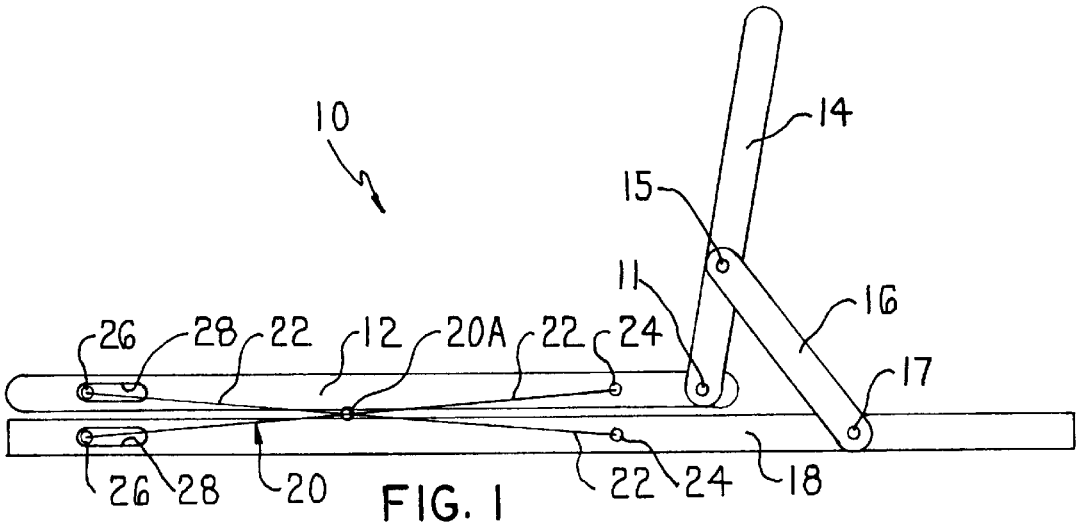
FIG. 1 is a schematic side elevational view of a patient support stretcher embodying the invention.
Figure 2:
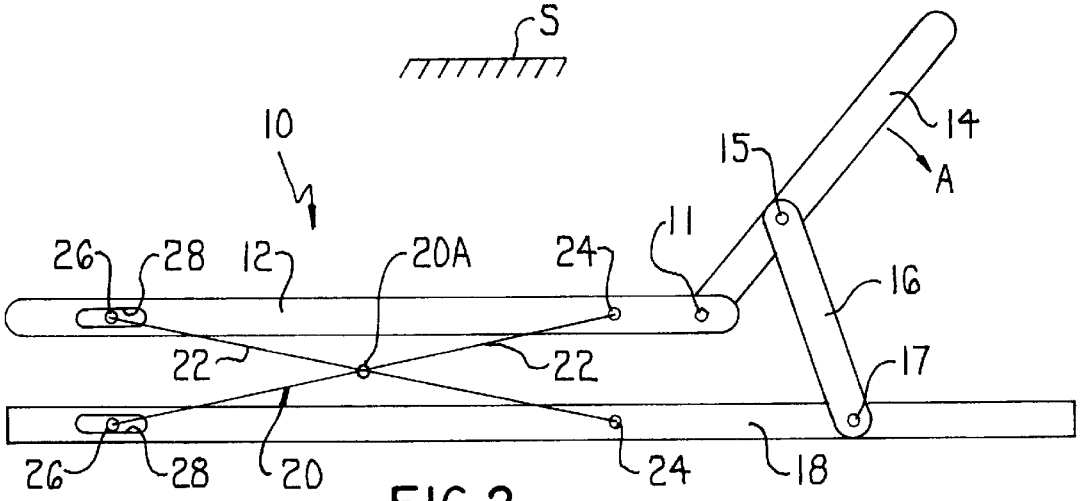
FIG. 2 is a schematic side elevational view illustrating the patient support stretcher in a position intermediate a lowered position and a raised position.
Figure 3:
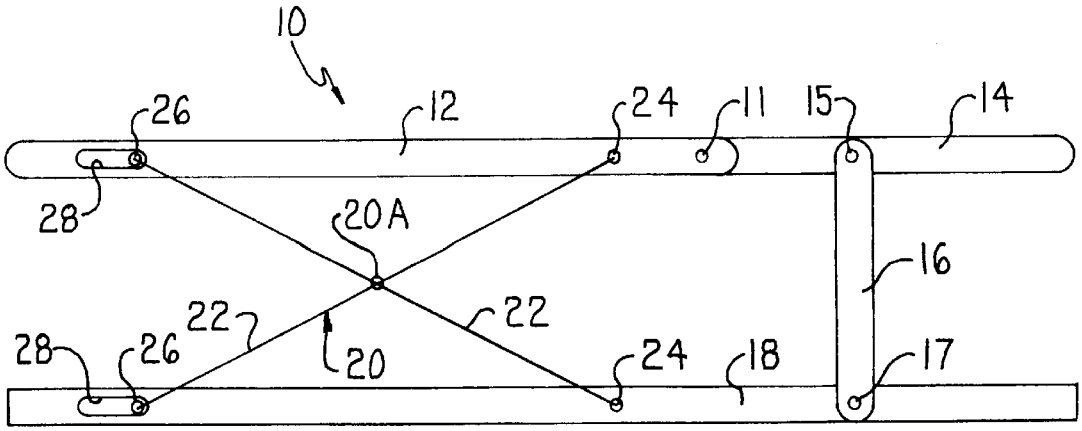
FIG. 3 is a schematic side elevational view of the patient support stretcher in the fully raised position.

A first embodiment of the patient support stretcher or bed assembly of the present invention is generally shown at 10 in FIGS. 1–3. The stretcher 10 includes a main or foot section 12 and a fowler section 14 pivotally attached to the foot section 12 by a hinge 11. A strut or elongate link (or a laterally spaced pair thereof) 16 pivotally interconnects, as at 15 and 17, the fowler section 14 to a stationary and/or elevatable base or frame 18. An X-lift mechanism 20, comprising two sets of laterally spaced connected arms 22, interconnects the foot section 12 to the frame 18. Each of the X-lifts 20 have two connecting arms interconnected at 20A and four pivot points 24, 26; two stationary pivot points 24 and two sliding pivot points 26. One stationary pivot point 24 and one sliding pivot point 26 is attached to the foot section 12 and one stationary pivot point 24 and one sliding pivot point 26 is attached to the frame 18. Both the foot section 12 and the frame 18 include an integral slot 28 to allow the corresponding sliding pivot point 26 to move therein.

FIG. 1 illustrates the bed assembly 10 in a low, relative to floor surface S, seating position wherein the foot section 12 overlays the frame 18 and the X-lift 20 is completely collapsed. The strut 16 maintains the fowler section 14 in an upright position. If a user desires to recline or elevate a patent, the user simply pulls rearward and downward on the fowler section 14. The strut 16 which carries the patient's weight and the weight of the patient assist in this operation.

As shown in FIG. 2, the main section 12 moves upward and away from the frame 18 as the fowler section 14 begins to move rearward and downward in the direction of arrow A. The strut 16 is supporting the patients weight. The distance between the axis of the hinge 11 and the axis of the pivot joint 15 is shorter than the distance between the axis of the pivot joint 15 and the top or head end of the fowler section 14 so as to provide the requisite leverage system for this movement to make it necessary for the attendant to use only little force to assist in this movement. Each sliding pivot point 26 will move within the integral slots 28 to allow the X-lift 20 to expand upwardly to the position illustrated in FIG. 3.

Figure 4:
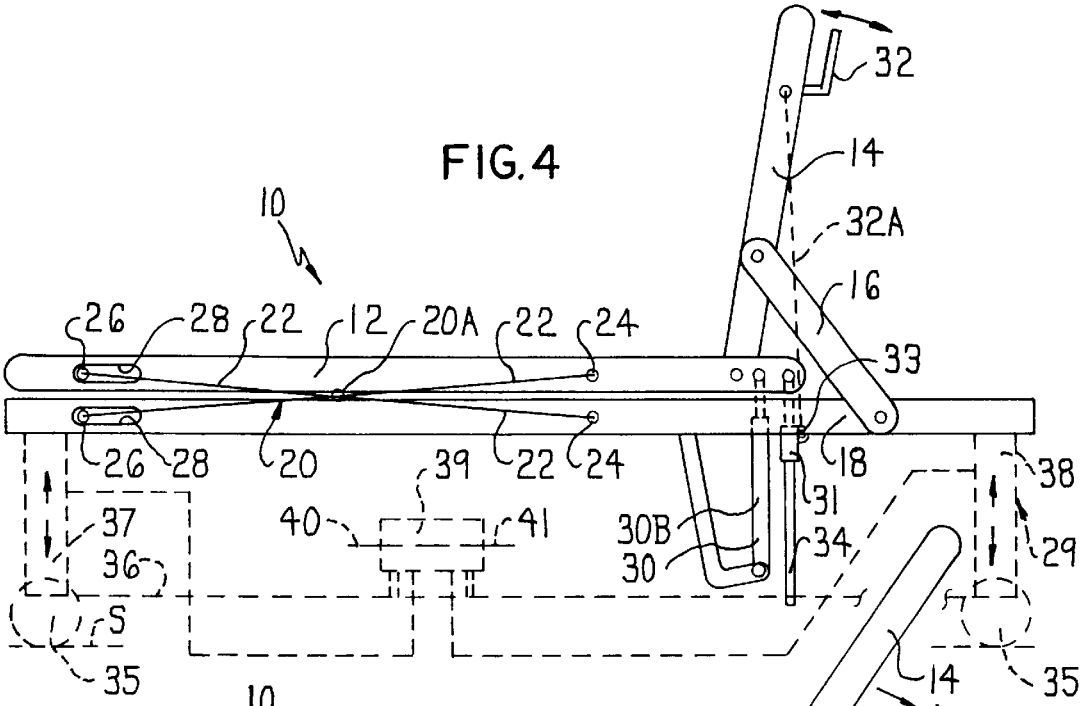
FIG. 4 is a schematic side elevational view of a second embodiment of the patient support stretcher embodying the invention.
Figure 5:
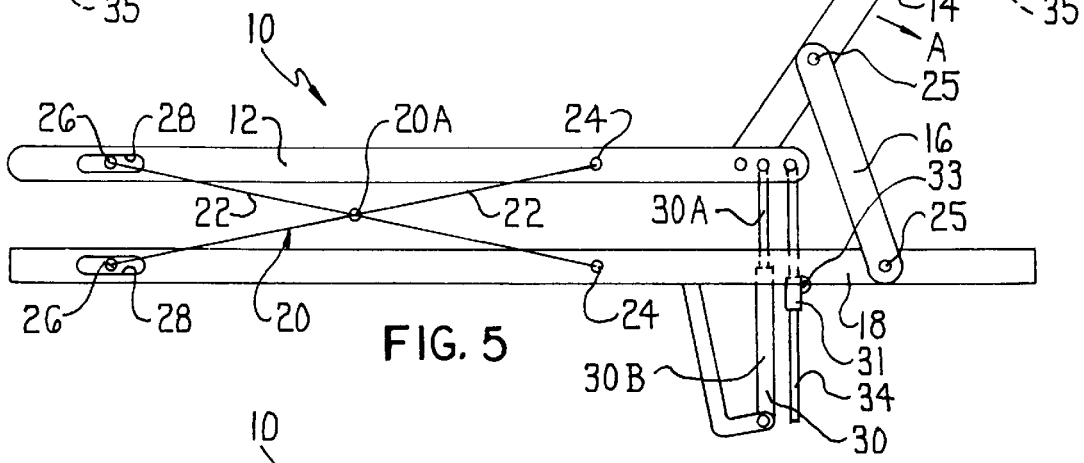
FIG. 5 is a schematic side elevational view of the second embodiment of the patient support stretcher in a position intermediate the lowered position and the raised position.
Figure 6:
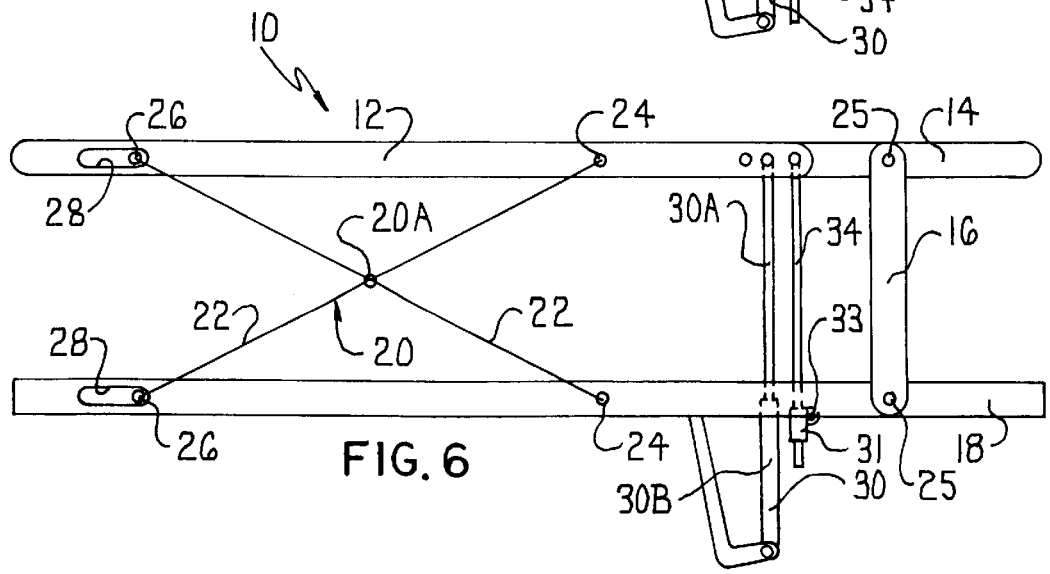
FIG. 6 is a schematic side elevational view of the second embodiment of the patient support stretcher in the fully raised position.

In the second embodiment of FIGS. 4–6, the overall structure is identical to that shown in FIGS. 1–3 and described above. Therefore, the same reference numerals and characters will be used in the following description to reference the corresponding components. The unique difference between the first and second embodiments is that, in addition to the showing of a conventional wheeled base 29, is the provision of a conventional sleeve-like lock mechanism 31 fixed to, as at 33, the main frame 12 and is located between the main section 12 and the frame 18 to lock and retain the main section 12 and fowler section 14 in various raised positions, such as those of FIGS. 2 and 3. The lock mechanism 31 provides an infinite adjustment range and is releasable from engagement with a straight rod 34 suspendedly connected at one thereto to the main section 12 adjacent the hinge 11 and extending through the sleeve-like lock mechanism 31 via a lever 32 shown only in FIG. 4 of the second embodiment, which is mounted on the fowler section 14 and is operatively connected to the sleeve-like lock mechanism 31 by a cable or the like schematically illustrated as at 32A. If the user desires to raise the patient higher or further recline the patient, the user actuates the lever 32 which releases the lock mechanism 31 and then pulls with minimal force rearward and downward in the direction of arrow A on the fowler section 14. Because of the near balanced design, the fowler section moves virtually effortlessly and requires only a small force to move from and between a seated and a reclined position. Little or no force is required to move in the reverse direction as the weight of the patient will urge the main section 12 downwardly.

FIGS. 3 and 6 both show the bed assembly 10 in a fully raised or reclined position wherein the main section 12 and the fowler section 14 form a flat bed. As before, the strut 16 supports the majority of the patients weight and the sliding pivot points 26 have moved to allow the necessary extension of the X-lift 20. It will be noted that the two pivots 25 for the strut are now vertically aligned.

This mechanically advantageous design allows a user to raise a patient with a minimal amount of effort. If an attendant desires to lower the patient, the attendant simply actuates the lever 32 to release the latch mechanism 31 to allow the bed assembly 10 to collapse under the patients weight. In the second embodiment, a conventional compression dampening mechanism 30 is included to control the speed of the collapsing. A straight rod 30A is suspendedly connected to the main section 12 adjacent the hinge 11 and serves as a plunger received in a cylinder-like housing 30B. Fluid in the cylinder-like housing 30B is displaced in a well-known and controlled manner as the plunger enters the housing to control the aforesaid speed of the collapsing.

While the first embodiment of FIGS. 1–3 schematically illustrates only the patient support stretcher 10, it is to be understood that all of the stretcher embodiments disclosed herein are generally wheel supported to enable the stretcher to be moved from place to place with or without a patient thereon. Wheels 35 (FIG. 4) are schematically illustrated and are rotatably secured to an undercarriage 36. Also, a pair of elevatable hydraulic jacks 37 and 38 are mounted on the undercarriage 36 and extend to and are connected to the frame 18. The jacks 37 and 38 can be extended so as to raise the frame 18 and the components mounted to it vertically by a pumping action (up and down) on a foot pedal activated device 39 mounted on the undercarriage 36. The jack 37 may be lowered independent of the jack 38 by operation of a pedal 40. Similarly, the jack 38 may be lowered independently of the jack 37 by operation of a foot pedal 41. Three separately activatable pedals for control of the two jacks 37 and 38 are well known in the art, such as from Dr. Homer H. Stryker's U.S. Pat. No. 3,304,116, and, as a result, further discussion thereof is deemed unnecessary.

Figure 7:
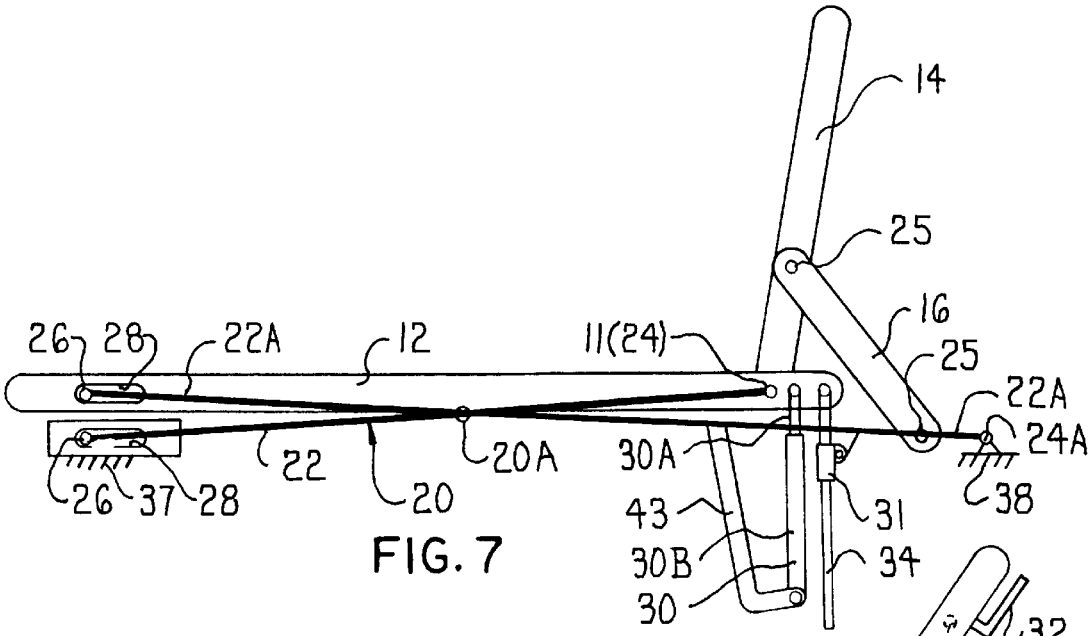
FIG. 7 is a schematic side elevational view of a third embodiment of the invention.
Figure 8:
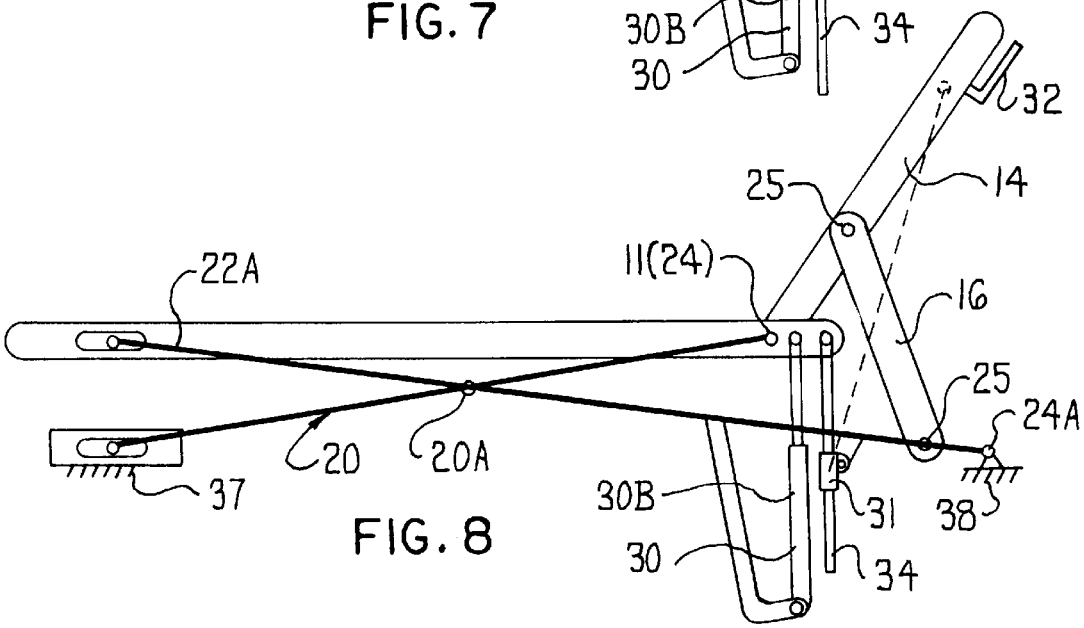
FIG. 8 is a schematic side elevational view of the third embodiment in a position intermediate the lowered position and the raised position.
Figure 9:
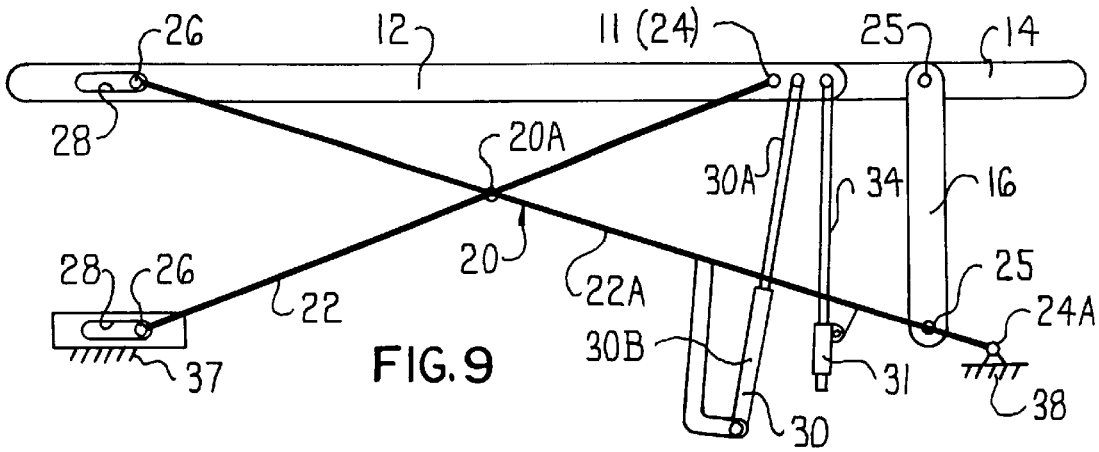
FIG. 9 is a schematic side elevational view of the third embodiment in the fully raised position.

A third embodiment of the invention is illustrated in FIGS. 7–9. In this particular embodiment, it will be noted that the frame 18 disclosed in the previous two embodiments has been eliminated. While a frame component 42 continues to exist and to which the hydraulic jacks 37 and 38 of the second embodiment may be operatively connected, the main frame 12 and hingedly connected fowler section 14 as well as the elongate link or strut 16 are all connected directly to the connecting arms 22. More specifically, it will be noted that in the two previous embodiments, the arms 22 of the X-shaped configurations are of the same length. In the third embodiment, the arm 22A is longer than is the arm 22. The arm 22 is connected to and extends between the jack 37 and the main section 12. However, the arm 22A extends from the pivot point 26 on the main frame 12 to a pivot 24A mounted to the jack 38 oriented beneath the fowler section 14. A support bracket 43 for the compression dampening mechanism 30 is suspended directly from the arm 22A intermediate the pivot 20A and the pivot point 24A. In the two preceding embodiments, the support bracket is suspended directly from the frame 18. The sleeve-like lock mechanism 31 is suspended directly from the arm 22A at a location intermediate the pivot 20A and the pivot joint 24A of the arm 22A of the X-lift mechanism 20. In the two preceding embodiments, the sleeve-like lock mechanism 31 is connected directly to and is suspended from the frame 18. Further, the elongate link 16, at an end thereof remote from the fowler section 14, is pivotally connected as at 25A directly to the arm 22A adjacent the pivot 24A. Lastly, the end of the arm 22 adjacent the fowler section 14 is pivotally connected to the main section 12 at the hinge 11 also interconnecting the main section 12 and fowler section 14, instead of at a separate pivot point 24. Other than the aforementioned changes, the concept illustrated in the third embodiment of FIGS. 7–9 is the same as the two preceding embodiments.

Again, each embodiment is adapted to be supported on a wheel supported undercarriage 36 only illustrated in FIG. 4. Additionally, each embodiment has elevatable hydraulic jacks corresponding to the jacks 37 and 38 illustrated also in FIG. 4.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A patient support stretcher, comprising:

a base adapted for support on a floor surface;

means defining an elongate patient support surface oriented above said base, said patient support surface including a fowler section and a main section pivotally secured to one another along a first pivot axis extending transversely to a longitudinal axis of said patient support surface;

an elongate link, said fowler section being pivotally connected at a second pivot axis to one end of said elongate link at a location intermediate said first pivot axis and an end of said fowler section distal said first pivot axis, a second end of said elongate link being pivotally connected at a third pivot axis to said base;

an X-lift mechanism consisting of at least one pair of arms, said arms being connected to one another at a pivot joint to form an X-shaped configuration, one end of each said arm being pivotally connected to said base at a first horizontal spacing therebetween, a second end of each said arm being pivotally connected to said main section also at said first horizontal spacing; and means for accommodating a change in said horizontal spacing between respective said one ends and respective said second ends as said arms of said X-shaped configuration pivot about said pivot joint during a movement of said fowler section relative to said main section to simultaneously cause a respective raising and lowering of said patient support surface relative to said base, said first pivot axis being a first fixed distance from said second pivot axis while a second fixed distance exists between said second pivot axis and said end of said fowler section distal said first pivot axis so that when said fowler section is pivoted about said first pivot axis to a second position oriented at an obtuse angle to said main section, said main section is then oriented beneath a position of said main section when it was generally coplanar with said fowler section.

2. The patient support stretcher according to claim 1, wherein said at least one pair of arms comprises a first pair of arms, said X-lift mechanism includes an additional second pair of arms laterally spaced from said first pair of arms and connected to one another at a second pivot joint axially aligned with said first pivot joint, said additional pair of arms forming an X-shaped configuration.

3. The patient support stretcher according to claim 2, wherein pivot connections connect respective said first and second ends of said first and second pairs of arms to said base and said main section, said pivot connections including a first pair of laterally spaced, axially aligned, horizontally elongated slots in said base receiving therein a first axle secured to said one ends of one arm of each X-shaped configuration, and a second pair of laterally spaced, axially aligned, horizontally elongated slots in said main section receiving therein a second axle secured to said second ends of one said arm of each X-shaped configuration, said first and second axles being movable along the length of respective said slots in response to changes in elevation of said main section relative to said base.

4. The patient support stretcher according to claim 3, wherein said first and second slots are located adjacent an end of said main section remote from said first pivot axis and said fowler section.

5. The patient support stretcher according to claim 4, wherein said pivot connections connecting said first and second ends of said arms to respective said base and said main section include a first pair of laterally spaced, axially aligned and fixed axles pivotally securing said one ends of the other arms of each said X-shaped configuration to said base, and a second pair of laterally spaced, axially aligned and fixed axles pivotally securing said second ends to said other arms of each said X-shaped configuration to said main section.

6. The patient support stretcher according to claim 1, wherein a latch mechanism is provided for controlling a movement of said main section between said raised and lowered positions.

7. The patient support stretcher according to claim 6, wherein said latch mechanism includes a straight rod suspended from said main section and a sleeve on said base through which said rod passes, said sleeve including means for restricting relative movement between said sleeve and said rod.

8. The patient support stretcher according to claim 7, wherein a manually manipulatable lever is provided on said patient support surface and includes a linkage interconnecting said lever to said means for restricting relative movement between said sleeve and said rod.

9. The patient support stretcher according to claim 6, wherein a speed damper is provided for limiting a speed of movement of said main section toward said base.

10. The patient support stretcher according to claim 9, wherein said speed damper includes a gas compression mechanism interposed between said main section and said base.

11. The patient support stretcher according to claim 1, wherein said base is supported on a wheeled undercarriage.

12. The patient support stretcher according to claim 10, wherein at least one lifting jack is interposed between said wheeled undercarriage and said base to raise and lower said base relative to said floor surface.

13. The patient support stretcher according to claim 11, wherein a pair of independently operable lifting jacks are respectively interposed between said wheeled undercarriage adjacent one end of said patient support surface and adjacent an opposite end of said patient support surface and said base to selectively and independently raise and lower the ends of said base relative to said floor surface.

14. The patient support stretcher according to claim 1, wherein said first distance is smaller than said second distance.

15. A patient support stretcher, comprising:

a base;

a main section coupled to said base through at least one pair of crossbars forming an X-shaped configuration, said crossbars being pivotally connected to one another and pivotally connected to said base and said main section;

a fowler section hinged to said main section; and a strut fastened to said fowler section and fastened to said base.

16. A patient support stretcher, comprising:

a base;

a main section coupled to said base through at least one pair of crossbars forming an X-shaped configuration, said crossbars being pivotally connected to one another and pivotally connected to said base and said main section;

a fowler section hinged to said main section; and a strut having one end pivotally connected to said fowler section and a second end pivotally connected to said base.

* * * * *